US008333511B2

(12) United States Patent
Rutzinger et al.

(10) Patent No.: US 8,333,511 B2
(45) Date of Patent: Dec. 18, 2012

(54) AT LEAST TWO-LAYER LABEL FOR OPENING AND CLOSING PACKAGES AND THE USE THEREOF

(75) Inventors: Elke Rutzinger, Kunten (CH); Thomas Scheubner, Bad Sackingen (DE)

(73) Assignee: Bandfix AG, Bergdietikon (CH)

( * ) Notice: Subject to any disclaimer, the term of this patent is extended or adjusted under 35 U.S.C. 154(b) by 1109 days.

(21) Appl. No.: 11/568,668

(22) PCT Filed: Mar. 6, 2006

(86) PCT No.: PCT/EP2006/060492

§ 371 (c)(1),
(2), (4) Date: Dec. 11, 2007

(87) PCT Pub. No.: WO2006/092447

PCT Pub. Date: Sep. 8, 2006

(65) Prior Publication Data

US 2008/0199109 A1 Aug. 21, 2008

(30) Foreign Application Priority Data

Mar. 4, 2005 (DE) ..... 10 2005 010 569

(51) Int. Cl.
*B65D 33/00* (2006.01)
*B65D 33/16* (2006.01)

(52) U.S. Cl. ..... 383/203; 383/205; 383/211; 383/66

(58) Field of Classification Search ..... 383/203, 383/204, 205, 208, 906, 66, 210–211, 103
See application file for complete search history.

(56) References Cited

U.S. PATENT DOCUMENTS 2,340,651 A * 2/1944 Denison ..... 229/123.1
3,329,331 A * 7/1967 Morgan ..... 229/247
4,258,876 A * 3/1981 Ljungcrantz ..... 229/125.14
4,464,154 A * 8/1984 Ljungcrantz ..... 493/87
4,679,693 A * 7/1987 Forman ..... 383/203
5,029,712 A * 7/1991 O'Brien et al. ..... 229/87.05
5,035,518 A 7/1991 McClintock (Continued)

FOREIGN PATENT DOCUMENTS

EP 0 331 027 9/1989

(Continued)

OTHER PUBLICATIONS

Handbook of pressure sensitive adhesive technology, second edition, edited by Donatas Satas, Van Nostrand Reinhold, New York, 1989.

*Primary Examiner* — Jes F Pascua
(74) *Attorney, Agent, or Firm* — Norris McLaughlin & Marcus P.A.

(57) ABSTRACT

An at least two-layer label for opening and closing flexible packages provided with a pre-cut opening closable with a cover, having a base label provided with a first adhesive layer having a weakened cut-off area which is placed over the pre-cut opening, and a covering label whose lower part is provided with a second adhesive layer by which it is adhered to the base label; the adhesive strength of the base label to the package being greater than the adhesive strength of the covering label to the base label.

12 Claims, 4 Drawing Sheets

U.S. PATENT DOCUMENTS

| | | | | |
|---|---|---|---|---|
| 5,310,262 | A * | 5/1994 | Robison et al. | 383/205 |
| 6,056,141 | A * | 5/2000 | Navarini et al. | 220/269 |
| 6,113,271 | A | 9/2000 | Scott et al. | |
| 6,428,867 | B1 | 8/2002 | Scott et al. | |
| 7,565,976 | B2 * | 7/2009 | Nakamura et al. | 206/494 |
| 7,665,629 | B2 * | 2/2010 | Julius et al. | 221/63 |
| 7,717,620 | B2 * | 5/2010 | Hebert et al. | 383/203 |
| 2012/0177307 | A1 * | 7/2012 | Duan et al. | 383/211 |

FOREIGN PATENT DOCUMENTS

| | | |
|---|---|---|
| FR | 2766794 | 2/1999 |
| WO | WO 93/17933 | 9/1993 |
| WO | WO 2005056420 A1 * | 6/2005 |

* cited by examiner

AT LEAST TWO-LAYER LABEL FOR OPENING AND CLOSING PACKAGES AND THE USE THEREOF

This is a 371 of PCT/EP2006/060492 filed 6 Mar. 2006 (international filing date).

The invention relates to an at least two-layer label for opening and reclosing flexible packs having a precut opening and also to its use. Packs of this kind contain, for example, oil-impregnated or emulsion-impregnated wet wipes.

BACKGROUND OF THE INVENTION

Industrial labels are used in numerous sectors for high-value applications: for instance, as model identification plates for vehicles, machines, and electrical and electronic devices, as process control labels, as guarantee badges and testing plaquettes, and also as closure labels.

For the opening and closing of flexible packs such as flexible pouches having a precut opening, which are used to store wet wipes, for example, it is common to use single-ply labels.

Perforated into the packaging film of the flexible pouch is a lid which forms the subsequent opening hole. Through the opening hole the wet wipes can be removed. The hole is overstuck with the label, and at the first opening the perforation of the lid is torn open; that is, the piece of film forming the lid remains adhering to the underside of the label.

The labels usually have a grip tab which either is adhesive-free or whose adhesive has been neutralized. In order to prevent the label being peeled off completely from the pouch when the pack is opened, the majority of these labels possess a forced diecut, which results in a certain resistance arising when the label has been opened to that point. The resistance indicates to the user that he or she should not continue peeling. Another way of preventing the label being peeled off completely is to use two different adhesives: detachable, in the region in which the label is to be peeled from the packaging film (opening of the pack), and permanent, at the hinge, in order to prevent complete detachment.

These labels for wet-wipe packs are composed of three successive, different zones: zone 1, nonadhesive; zone 2, detachably adhesive; zone 3, permanently adhesive.

EP 0 331 027 A1 discloses a reclosable dispensing container for oil-impregnated wet wipes, which consists of a container and a key part. The container is to be closed using a single-ply label. Closing the container by means of the label, however, is unsatisfactory. On the one hand, this type of closure is not sufficiently impervious to rule out the penetration of dirt or dust into the container, and on the other hand, from just a visual standpoint, the label is not very appealing, particularly if the bond strength to the container subsides.

WO 93/17933 A likewise discloses a container which serves to accommodate moist cloths which are located in turn in an airtight pouch. The pouch is kept in the container. The pouch, moreover, is reversibly closed with a single-ply label. Here as well the disadvantages outlined are manifested.

It is an object of the present invention to provide a label which is easy to open and yet bonds securely on the substrate, in particular the pack, and which in particular—not like the known labels—is largely resistant to oil which may exude from wet wipes which are located within a pack closed reversibly with the label of the invention.

SUMMARY OF THE INVENTION

The invention accordingly provides an at least two-layer label for opening and reclosing flexible packs which have a precut opening, closed with a lid.

The label is composed of a base label

- whose underside is furnished with a first adhesive layer, which if appropriate prior to the bonding of the label is lined with a release paper or release film,
- in which there is provided a section whose connection to the rest of the base label is weakened or severed, and having an outer label,
- whose underside is furnished with a second adhesive layer, by means of which the outer label is bonded on the base label, the bond strength of the base label on the base on which the label is bonded being higher than the bond strength of the outer label on the base label, and the bond strength between section and outer label being higher than the force needed to separate the lid in the pack, by means of the section bonded thereon, from the pack.

At the same time this bond strength is therefore higher than the force required to separate the section from the base to which the label is adhered.

If appropriate there are provided on the outer label further, protective labels, which for example may contain additional information in fan-fold form.

In another embodiment of the invention the label is composed of a base label

- whose underside is furnished with a first adhesive layer, which if appropriate prior to the bonding of the label is lined with a release paper or release film,
- in which a section has been removed, the resulting opening in the base label being disposed above the lid of the pack, and having an outer label

- whose underside is furnished with a second adhesive layer, by means of which the outer label is bonded on the base label, the bond strength of the base label to the base on which the label is bonded being higher than the bond strength of the outer label to the base label, and the bond strength between outer label and lid being higher than the force needed to separate the lid from the pack.

If appropriate there are provided, on the outer label, further, protective labels, which for example may contain additional information in fan-fold form.

In this case, during the production of the label, the section is diecut from the base label and removed before the base label and the outer label are joined.

DETAILED DESCRIPTION

The different bond strengths can be achieved by making the first adhesive coating more strongly adhesive than the second adhesive coating. in this case it is necessary to ensure that between section and outer label, as necessary, a sufficiently high bond strength is set in order that the section can be removed from the base label during the operation of opening.

The label is used preferably on flexible packs having a precut opening such as flexible pouches in which there are oil-impregnated wet wipes (known in the form of baby wipes or make-up wipes).

In the flexible pouch it is usual, as a result of kiss-cutting, for there to be a lid which is connected to the flexible pouch in such a way that, although this lid can be removed without problems, it is nevertheless airtight and watertight. After the lid has been removed, an opening forms in the pouch, through which the wet wipes can be removed.

The label of the invention is then bonded on the pack, by first removing the release paper—where present—from the first adhesive coating and then firmly adhering the label, or base label, to the pack by means of the first adhesive coating. The section present in the base label lies as far as possible congruently above the lid in the pack. In one advantageous embodiment of the invention, therefore, the section in the base label has a greater area than the lid or the opening in the pack. In practice it has proven to be the case that, in particular, a section with a protruding edge 2 mm wide yields outstanding results.

In another preferred embodiment the outer label has a greater area than the base label, and in particular a segment of the outer label extends over an edge of the base label.

In this case, in the production of the label, this segment can be diecut from the base label and removed before the base label and the outer label are joined.

When the label of the invention is applied to the pack, the segment in which the outer label overhangs the base label comes to a direct bonding of the outer label on the pack. In this way a hinge is formed, up to which the outer label can be peeled.

Moreover, in accordance with the invention, further parts in the base label can be separated off by diecutting or by other techniques such as lengthwise or transverse slitting, before the base label and the outer label are joined.

With further preference there is at least one further segment, provided in particular in the edge region of the base label, in which the bond strength between outer label and base label is increased.

This can be achieved through the use of two different adhesives within the second adhesive layer. For this purpose a detachable adhesive which exhibits low bond strengths is used in the region in which the outer label is to be peeled (when the pack is opened). In the region of the segment, in contrast, an adhesive is used which exhibits higher bond strengths, in order to prevent the complete detachment of the outer label.

In another advantageous development the bond strengths of parts of the adhesive coating can be lowered, by means of irradiation, powdering or partial neutralization, for example.

The outer label, whose area is preferably congruent with the base label, is bonded to the base label by means of the second adhesive layer.

Wither further preference, apart from the surface of the section, the top face of the base label is abhesive. On the top face of the base label preferably at least one further segment, provided in particular in the edge region of the base label, is not abhesive.

The base label is abhesively furnished preferably by means of siliconization.

Another possibility is to apply a primer or varnish that generates an abhesive effect.

The surface of the base label can then be modified, by irradiation or chemical treatment such as etching, to establish an abhesive effect.

At the abhesive points the detachment of the outer label from the base label during the operation of opening the label is made easier. On the other hand, the bonding between base label and outer label in the nonabhesive segment is stronger, so that complete detachment of the outer label from the base label is not observed.

In a further preferred embodiment of the invention, on the underside of the outer label at an edge region, an area is free of adhesive or the bond strength is reduced. This area then serves as a grip tab for peeling the outer label.

This grip tab is preferably disposed in such a way that it is located at an edge opposite the nonabhesive segment in the base label.

Another way of producing a grip tab is to enclose the adhesive that forms the area in release paper, so that the adhesive is unable to develop any effect. Furthermore, the adhesive in this region can also be neutralized, by imprinting or powdering, for example.

As a result of the abhesive treatment of the base label in conjunction with the grip tab outlined, the outer label is easy to peel, and can be peeled up to the segment of the base label that has not been made abhesive. In this region the bond strength between outer label and base label is so great that separation is possible only with force.

Moreover, after a wipe has been removed, the outer label can be applied again reversibly to the base label; the residual bond strength holds the outer label repeatedly in position.

In a further advantageous embodiment, therefore, in the region of the nonabhesive segment of the base label, the outer label has a line of weakening, specifically at the transition of the permanent connection to the detachable connection.

This line of weakening may be a perforation, where appropriate in the known and well-established corrugation form. This form reduces the resilience forces of the outer label, and accordingly the label does not fall back (or at least not so easily)—in other words, the pack stays open without the need for a hand to hold it open.

During the operation of opening the label, the outer label passes over the section in the base label and also over the lid provided in the pack. The section in the base label whose top face is preferably not abhesive remains hanging, as it were, from the outer label. At the same time the lid of the pack, which is connected firmly by means of the first adhesive coating to the segment in the base label, is released from its connection to the pack, and exposes the opening.

The operation of opening can be continued until the line of weakening which is preferably present is reached, the line at which the bonding undergoes transition from the removable configuration into the fixed configuration.

The top face and underside of the outer label can be imprinted, but need not be. The base label may likewise be imprinted.

The advantages of the label of the invention, especially in preferred embodiments, are set out as follows.

The manufacture of a grip tab by non-coating with adhesive renders subsequent neutralization superfluous. In a specific case, however, it may of course be advantageous to coat the outer label with adhesive even in the region of the grip tab and subsequently to neutralize this adhesive or to weaken it by means of partial neutralization.

The label is easily opened, since, rather than the label being peeled from the pack(aging film), the outer label is peeled from the base label.

Nevertheless, secure bonding on the pack is ensured through the base label.

In contrast to single-layer labels, in which the bond strength is necessarily a compromise between reclosing and opening, so that fluids emerging from the pack, such as oil, considerably reduce the functional capacity of the adhesive, which is in any case already weak, and hence of the label, with the label of the invention the damage the oil can do is limited. The adhesive that attaches the base label to the pack develops sufficiently high bond strengths, so that oil causes no critical reduction.

No dishing of the label is observed. Furthermore, three sides (top face and underside of the outer label and top face of the base label) are printable; in other words, much more information is available than hitherto.

Backing materials available for selection for the outer label and base label, respectively, are papers or various films.

In accordance with the invention it is possible to use films as materials, especially monoaxially and biaxially oriented films based on polyolefins, more particularly films based on oriented polyethylene or oriented copolymers containing ethylene units and/or polypropylene units, and also, where appropriate, PVC films, PET films, films based on vinyl polymers, polyamides, polyesters, polyacetals, polycarbonates Additionally, films based on oriented polyethylene or oriented copolymers containing ethylene units and/or polypropylene units can be used in accordance with the invention.

Monoaxially oriented polypropylene is notable for its very high tensile strength and low machine-direction stretch. Preferred for the production of the labels of the invention are monoaxially oriented films based on polypropylene. The thicknesses of the monoaxially oriented films based on polypropylene are preferably between 20 and 100 μm, in particular between 25 and 65 μm, very particularly between 30 and 60 μm.

Monoaxially oriented films are predominantly single-layer, although in principle it is also possible for multilayer monoaxially oriented films to be produced. Known films are predominantly single-layer, two-layer and three-layer films, although the number of layers selected may also be greater.

The thicknesses of the biaxially oriented films based on polypropylene are in particular between 12 and 100 μm, particularly between 20 and 75 μm, very particularly between 30 and 60 μm.

Biaxially oriented films based on polypropylene can be produced by means of blown-film extrusion or by means of conventional flat-film units. Biaxially oriented films are produced in both single-layer and multilayer formats. In the case of the multilayer films it is also possible here for the thickness and composition of the different layers to be alike, although different thicknesses and compositions are also known.

Particularly preferred for the labels of the invention are single-layer, biaxially or monoaxially oriented films and multilayer biaxial or monoaxial films based on polypropylene that exhibit a sufficiently firm bond between the layers, since delamination of the layers during the application is a disadvantage.

Films based on unplasticized PVC are used for the production of labels, as are films based on plasticized PVC.

For the labels of the invention, then, it is common to use films based on unplasticized PVC. The thicknesses of the films are preferably between 20 and 100 μm, particularly between 25 and 65 μm, more particularly between 30 and 60 μm.

Polyester-based films, based for example on polyethylene terephthalate, are likewise known and can also be used for producing the labels of the invention. The thicknesses of the films based on PET are between 20 and 100 μm, particularly between 25 and 65 μm, very particularly between 30 and 60 μm.

The labels of the invention may comprise as adhesives an adhesive based on natural rubber, PU, acrylates or styrene-isoprene-styrene block copolymers.

The use of adhesives based on natural rubber, acrylates or styrene-isoprene-styrene is known, and is also described for example in the Handbook of pressure sensitive adhesive technology, second edition, edited by Donatas Satas, Van Nostrand Reinhold, New York, 1989.

As a self-adhesive compound use is made in particular of a commercially customary pressure-sensitive adhesive based on PU, acrylate or rubber.

With the aid of the figures described below a label, in one particularly advantageous configuration, is elucidated in more detail, without any intention thereby to restrict the invention unnecessarily.

Figure 1:
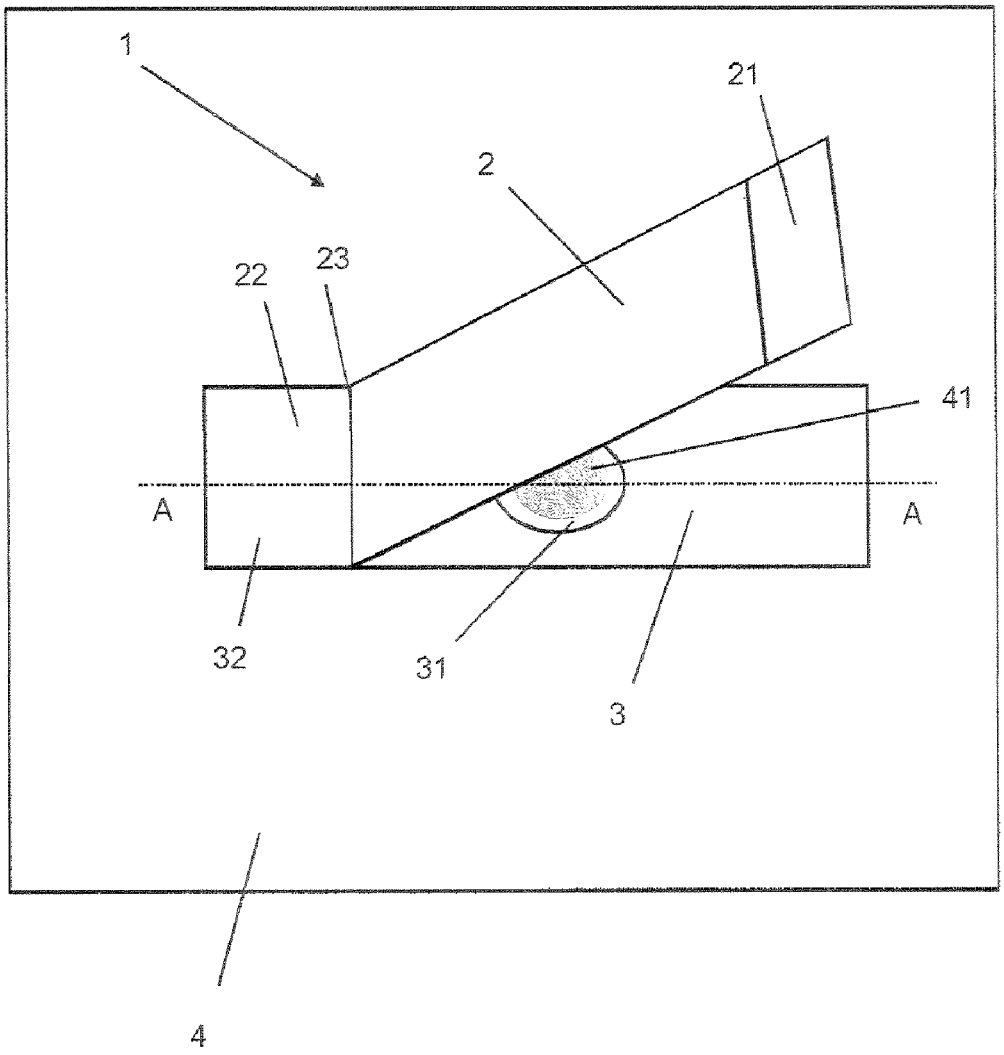
FIG. 1 shows the label, with the outer label folded open for improved illustration.

According to FIG. 1 the label 1 is composed of a base label 3 whose underside is furnished with a first adhesive layer (not shown). Provided in the base label 3 there is a section 31 whose connection to the rest of the base label 3 is weakened. The top face is abhesive as a result of silicone coating, the section 31 and also a further segment 32 provided in the edge region of the base label 3 being nonabhesive.

The outer label 2 (which is folded open for improved illustration) is furnished on its underside with a second adhesive layer (likewise not shown).

The outer label 2, whose area is congruent with the base label 3, is bonded releasably by means of the second adhesive layer to the base label 3 at the points at which the base label 3 has been rendered abhesive on its top face.

Using the first adhesive coating, the label 1 is adhered with the base label 3 to the flexible pouch 4, the flexible pouch 4 having a lid 41 which is connected to the flexible pouch 4 in such a way that this lid 41 can be released without problems but on the other hand is airtight and watertight.

Within the flexible pouch 4 there are, for example, oil-impregnated wet wipes (known in the form of baby wipes or make-up wipes).

The section 31 present in the base label 3 lies congruently above the lid 41 in the flexible pouch 4.

The section 31 has a somewhat greater area than the lid 41.

On the underside of the outer label 2 an area 21 at an edge region is free of adhesive.

This area 21 then serves as a grip tab for peeling off the outer label 2.

As a result of the abhesive treatment of the base label 3, the outer label 2 can be peeled off easily, up to the segment 32 of the base label 3 that has not been abhesively treated. In this region (22, 32) the bond strength between outer label 2 and base label 3 is so great that separation is possible only with force.

In the region of the nonabhesive segment (22, 32) of the base label 3, the outer label 2 has a line of weakening 23, specifically at the transition from the permanent connection to the detachable connection.

Figure 2:
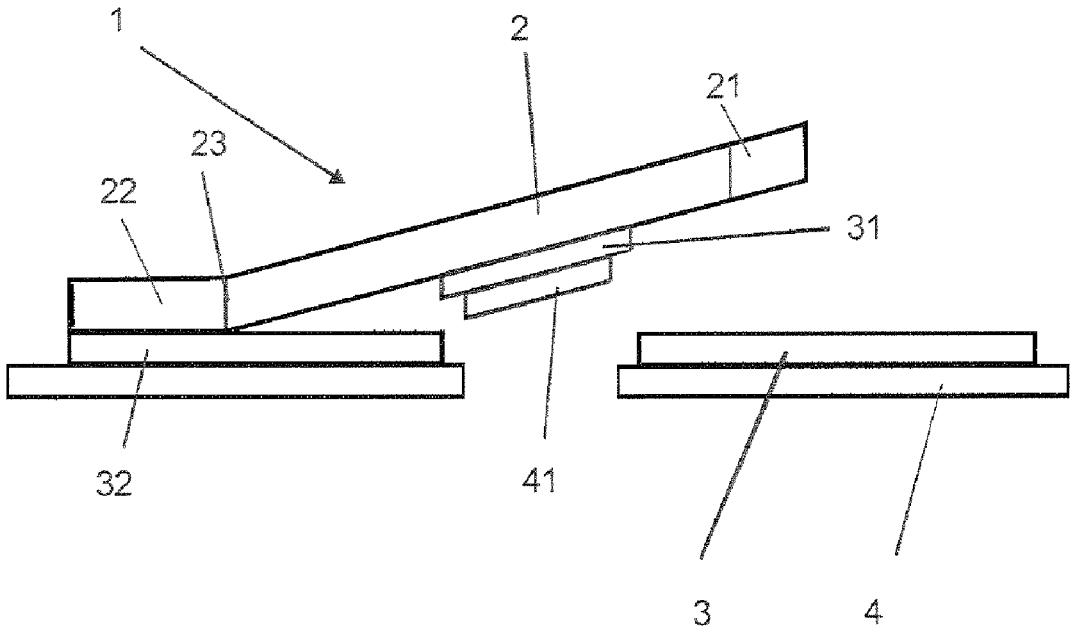
FIG. 2 shows the separated label in accordance with sectional line A-A from FIG. 1, having torn open the lid of the flexible pouch.

FIG. 2 shows the separated label 1 along sectional line A-A from FIG. 1, having torn open the lid 41 of the flexible pouch 4.

Only the upper ply of the flexible pouch 4 is shown. By virtue of the grip tab 21 having been pulled, the outer label 2 passes over the section 31 in the base label 3 and also over the lid 41 provided in the flexible pouch 4. The section 31 in the base label 3, whose top face is not abhesive, remains hanging, so to speak, on the outer label 2. At the same time the lid 41, which is joined firmly to the segment 31 in the base label 3 as a result of the first adhesive coating, is released from its connection and exposes the opening in the flexible pouch 4.

At the same time the holding points by which the section 31 is fixed in the base label 3 are severed, so that ultimately the section 31 from the base label 3 and also, atop it, the lid 41 are located below the outer label 2.

The operation of opening is continued until the line of weakening 23 has been reached, the line at which the adhesive bonding undergoes transition from the releasable configuration into the fixed configuration.

Figure 3:
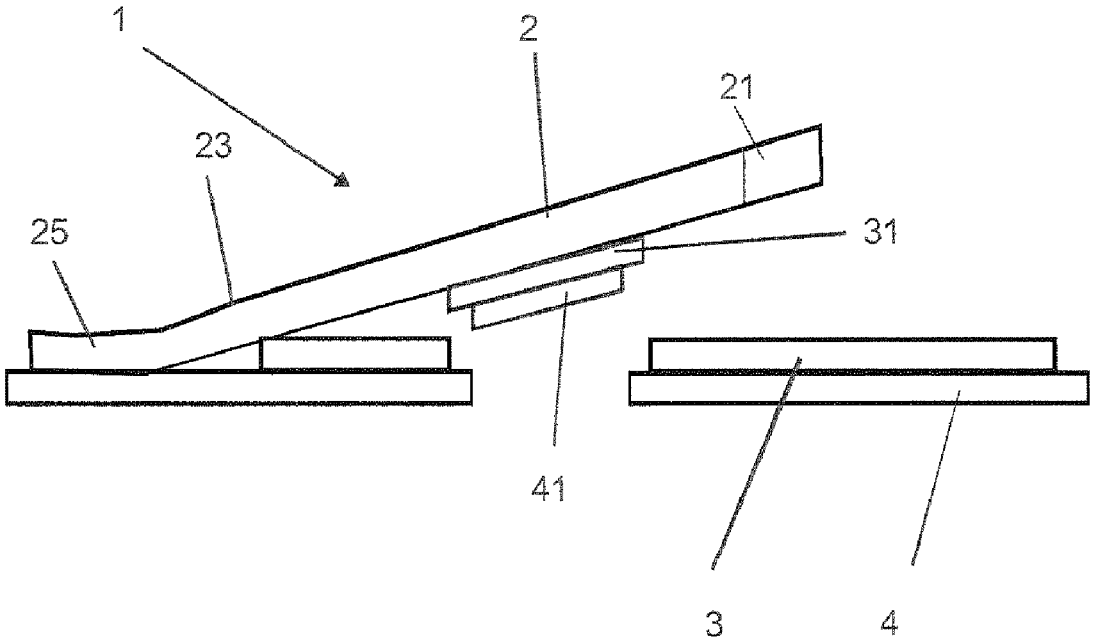
FIG. 3 shows the separated label similarly to FIG. 2.
Figure 4:
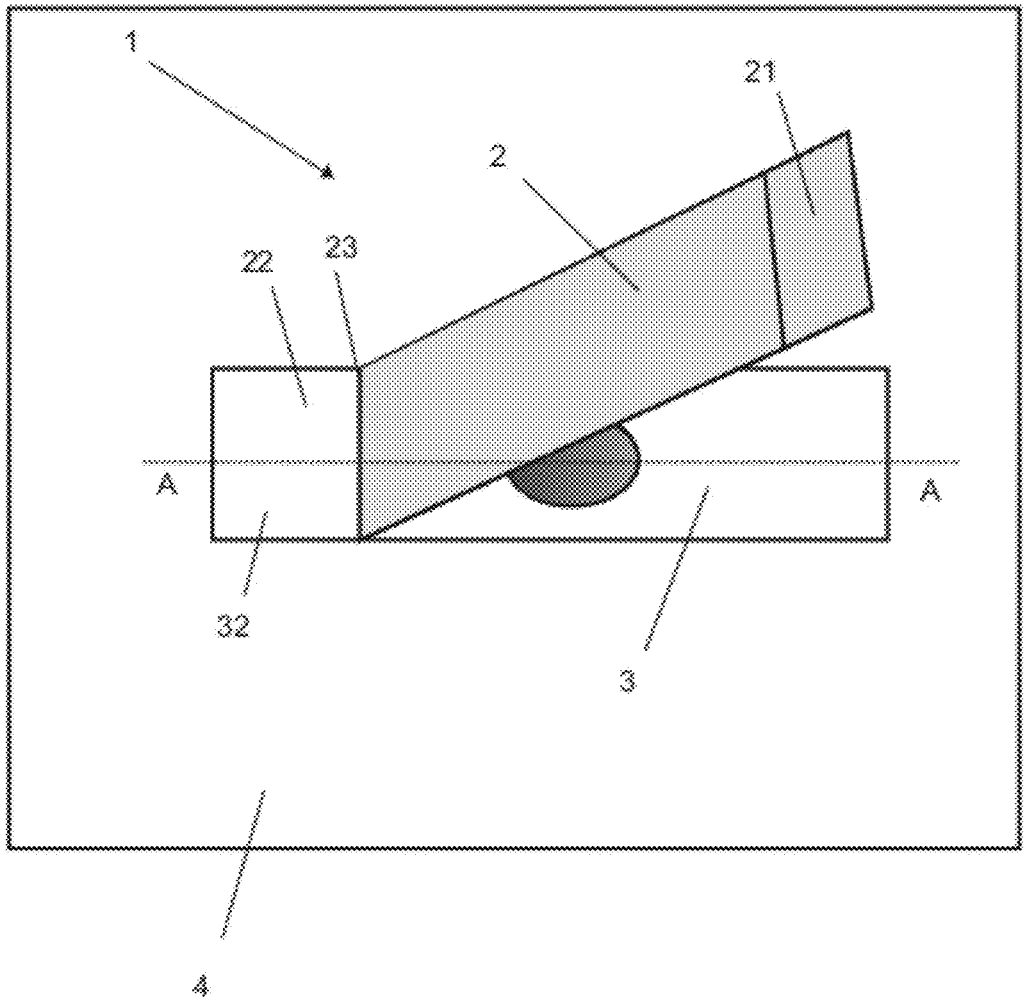
FIG. 4 shows the label of FIG. 1 with section 31 removed.

FIG. 3 shows a separated label 1 similarly to FIG. 2.

The outer label 2 has a greater area than the base label 3, with a segment 25 of the outer label 2 extending over an edge of the base label 3.

When the label 1 of the invention is applied to the flexible pouch 4, the segment 25 in which the outer label 2 overhangs the base label 3 comes to a direct bonding of the outer label 2 on the flexible pouch 4. In this way a hinge is formed, up to which the outer label 2 can be peeled.

The invention claimed is:

1. An at least two-layer label (1) for opening and reclosing a flexible pack which has a precut opening, closed with a lid, having a base label (3) having a top side and an underside, and whose underside is furnished with a first adhesive layer, which optionally prior to the bonding of the label (1) is lined with a release paper or release film, In which base label (3) there is provided a section (31) whose connection to the rest of the base label (3) is weakened or severed, and which is adapted to be disposed above the lid of said pack, the top side of base label (3), other than section (31) being abhesively furnished, and optionally a segment at the edge of base label (3) being abhesively furnished, and having an outer label (2) having a top side and an underside whose underside is furnished with a second adhesive layer, by means of which the outer label (2) covers said weakened or severed section (31), and is bonded on the base label (3), the bond strength of the base label (3) on the base on which the label (1) is bonded being higher than the bond strength of the outer label (2) on the base label (3), and the bond strength between section (31) and outer label (2) being higher than the force needed to separate the lid in the pack, by means of the section (31) bonded thereon, from the pack, and also optionally having further, protective labels provided on the outer label (2).

2. An at least two-layer label (1) for opening and reclosing a flexible pack which has a precut opening, closed with a lid, having a base label (3) having a top side and an underside and whose underside is furnished with a first adhesive layer, which optionally, prior to the bonding of the label (1) is lined with a release paper or release film, in which a section (31) has been removed to form an opening, the resulting opening in the base label being adapted to be disposed above the lid of the pack, the top side of base label (3), optionally other than a segment at the edge of base label (3) being abhesively furnished, and having an outer label (2) having a top side and an underside and whose underside is furnished with a second adhesive layer, by means of which the outer label (2) covers said opening in base label (3) and bonds to said lid, and is also bonded on the base label (3), the bond strength of the base label (3) on the base on which the label (1) is bonded being higher than the bond strength of the outer label (2) on the base label (3), and the bond strength between outer label (2) and lid being higher than the force needed to separate the lid from the pack, and also optionally having further, protective labels provided on the outer label (2).

3. The label of claim 1 or 2, wherein there is at least one further segment, at an edge of the base label (3), in which the bond strength between outer label (2) and base label (3) is increased.

4. The label of claim 1 or 2, wherein the outer label (2) has a greater area than the base label (3), and a segment of the outer label (2) extends over an edge of the base label (3).

5. The label of claim 1 or 2, wherein on the underside of the outer label (2) an edge area is free of adhesive, the bond strength of this area is reduced or the adhesive is covered over, and said area serves as a grip tab.

6. The label of claim 1 or 2, wherein said segment at said edge of said base label (3) is not abhesively furnished and, in the region of said segment of the base label (3) the outer label (2) has a line of weakening which is disposed at the transition between the nonabhesively furnished segment and the abhesively furnished portion of the base label (3).

7. The label of claim 1, wherein the section (31) is connected to the base label (3) by means of holding points.

8. The label of claim 1, wherein in the base label (3) the section (31) has a greater area than the opening in the pack.

9. The label of claim 1, wherein the top face of the base label (3) is furnished abhesively by means of siliconization.

10. A flexible packaging having a precut opening which is covered by a label of claim 1 or 2.

11. The flexible packaging of claim 10, wherein said flexible packaging is a flexible pouch.

12. The label of claim 2, wherein in the base label (3) the removed section (31) has a greater area than the opening in the pack.

* * * * *